US010944195B1

(12) United States Patent
Peng

(10) Patent No.: US 10,944,195 B1
(45) Date of Patent: Mar. 9, 2021

(54) DETACHABLE POWER CORD STRUCTURE FOR PORTABLE HAIR CURLER

(71) Applicant: Dongguan Lisi Intelligent Technology Co., Ltd, Guangdong (CN)

(72) Inventor: Jinhu Peng, Guangdong (CN)

(73) Assignee: Dongguan Lisi Intelligent Technology Co., Ltd, Guangdong (CN)

( * ) Notice: Subject to any disclaimer, the term of this patent is extended or adjusted under 35 U.S.C. 154(b) by 0 days.

(21) Appl. No.: 16/655,278

(22) Filed: Oct. 17, 2019

(30) Foreign Application Priority Data

Sep. 3, 2019 (CN) ..... 201910828380.0

(51) Int. Cl.
*H01R 13/187* (2006.01)
*H01R 13/22* (2006.01)
*H01R 13/10* (2006.01)
*A45D 6/00* (2006.01)

(52) U.S. Cl.
CPC ..... *H01R 13/187* (2013.01); *H01R 13/10* (2013.01); *H01R 13/22* (2013.01); *A45D 2006/005* (2013.01)

(58) Field of Classification Search
CPC .. H01R 13/5841; H01R 13/187; H01R 13/22; H01R 13/10; A45D 2006/005
USPC ..... 439/446, 534
See application file for complete search history.

(56) References Cited

U.S. PATENT DOCUMENTS 3,843,224 A * 10/1974 Gerke, Jr. ..... H01H 1/5866 439/366
5,399,093 A * 3/1995 Schneider ..... H01R 24/28 439/21
5,499,932 A * 3/1996 Tanaka ..... G01P 1/02 439/446
5,595,503 A * 1/1997 Pittman ..... H01R 13/56 439/11
6,793,499 B1 * 9/2004 Chen ..... H01R 13/652 439/13
7,234,963 B1 * 6/2007 Huang ..... H01R 13/56 439/446
8,968,023 B1 * 3/2015 Walters ..... H02G 3/0633 439/446
2007/0049105 A1 * 3/2007 Szczesny ..... H01R 13/567 439/446
2008/0261430 A1 * 10/2008 Wadsworth ..... H01R 35/04 439/295
2009/0098743 A1 * 4/2009 Wadsworth ..... H01R 35/04 439/13

(Continued)

*Primary Examiner* — Gary F Paumen
(74) *Attorney, Agent, or Firm* — JCIP Global Inc.

(57) ABSTRACT

The present invention discloses a detachable power cord structure for a portable hair curler, including a device tail sleeve and a tail wire. An elastic engaging assembly is arranged in the device tail sleeve, the tail wire is inserted into the device tail sleeve, and is engaged with the elastic engaging assembly. When the tail wire is engaged into the elastic engaging assembly, it can turn on the circuit and can be rotated freely. The power connector structure adopted by the present invention can be rotated through insertion of the device tail sleeve and the tail wire, and the elastic engaging assembly is arranged in the device tail sleeve. The tail wire can be rotated freely while the electrical connection is realized, and the tail wire is not bent or curved during use, thereby effectively ensuring the service life of the tail wire.

9 Claims, 2 Drawing Sheets

(56) References Cited

U.S. PATENT DOCUMENTS

| | | | | |
|---|---|---|---|---|
| 2009/0277660 | A1* | 11/2009 | Eriksson | H02G 11/00<br>173/217 |
| 2010/0130026 | A1* | 5/2010 | Honda | H01R 24/66<br>439/21 |
| 2015/0340774 | A1* | 11/2015 | Kellman | H01R 13/72<br>439/502 |

* cited by examiner

DETACHABLE POWER CORD STRUCTURE FOR PORTABLE HAIR CURLER

CROSS-REFERENCE TO RELATED APPLICATION

This application claims the priority benefit of China application serial no. 201910828380.0, filed on Sep. 3, 2019. The entirety of the above-mentioned patent application is hereby incorporated by reference herein and made a part of this specification.

BACKGROUND

Technical Field

The present invention relates to a hairdressing product, in particular to a detachable power cord structure for a portable hair curler.

Description of Related Art

At present, there are many kinds of electrical appliances for hairdressing, which have different functions according to different hairdressing effects, such as: hair curler, hair-straightening comb, hair-curling comb, hair iron, hair dryer, electric hair dryer comb or hair straightener, etc. The existing power connector parts of these appliances are generally connected through a fixed power cord slot on the casing. For power connectors that cannot be detached, they cannot be easily carried and arranged in places. This application can solve the above problems.

SUMMARY

The purpose of the present invention is to provide a detachable power cord structure for a portable hair curler in view of the above drawbacks of the related art.

In order to solve the above-mentioned defects of the related art, the technical solution provided by the present invention is: a detachable power cord structure for a portable hair curler, including a device tail sleeve and a tail wire, wherein the device sleeve is provided with an elastic engaging assembly, the tail wire is inserted into the device tail sleeve and is engaged with the elastic engaging assembly. When the tail wire is engaged with the elastic engaging assembly, it can turn on the circuit and can be rotated freely.

As an improvement of the detachable power cord structure for the portable hair curler of the present invention, the elastic engaging assembly includes a tail spring ring, one end of the tail spring ring that extends into the device tail sleeve is provided with a buckle, and a protrusion is disposed on an inner side of the buckle. A spring groove is provided on an inner side wall of the device tail sleeve, and a tail spring is disposed in the spring groove, the tail spring ring extends into the device tail sleeve and abuts against the tail spring.

As an improvement of the detachable power cord structure for the portable hair curler of the present invention, the tail wire has an insertion end, and the outer side of the insertion end is provided with an annular groove. The axial center of the insertion end is provided with a positive insertion port, and the insertion end is further provided with an annular negative insertion slot, and the protrusion of the buckle is docked with the annular groove.

As an improvement of the detachable power cord structure for the portable hair curler of the present invention, a socket terminal is further provided in the device tail sleeve, and the socket terminal is provided with a positive contact pin and an annular negative contact piece. The positive contact pin is inserted into the positive insertion port in an aligned manner, and the annular negative contact piece is docked with the annular negative insertion slot.

As an improvement of the detachable power cord structure of the portable hair curler of the present invention, when the tail spring is pushed to press the tail spring, the buckle moves along with the tail spring ring and is detached from the tail wire.

As an improvement of the detachable power cord structure of the portable hair curler of the present invention, the annular negative insertion slot is provided with a power negative contact terminal, and the positive insertion port is provided with a power positive contact terminal therein.

As an improvement of the detachable power cord structure of the portable hair curler of the present invention, the power negative contact terminal is disposed around the annular negative insertion slot.

As an improvement of the detachable power cord structure of the portable hair curler of the present invention, the other end of the tail wire is a power cord buried end, and an angle greater than 90 degrees is formed between the power cord buried end and the insertion end.

As an improvement of the detachable power cord structure for the portable hair curler of the present invention, a side of the power cord buried end is provided with a hanging hole.

As an improvement of the detachable power cord structure for the portable hair curler of the present invention, the power cord buried end and the insertion end are integrally injection molded.

Compared with the existing art, the present invention has the advantages that the power connector structure adopted by the present invention can be rotated through the insertion of the device tail sleeve and the tail wire, and the elastic engaging assembly is arranged in the device tail sleeve. The tail wire is inserted into the device tail sleeve and is engaged with the elastic engaging assembly. When the tail wire is engaged into the elastic engaging assembly, it can turn on the circuit and rotated freely. When the tail wire is electrically connected, it can be rotated freely without bending or curving during use, thereby effectively ensuring the service life of the tail wire, and to some extent, it has a protective effect on the power cord. Moreover, the power connector of the product can be adapted to the power docking of various hairdressing appliances, can be replaced at will, and has high versatility.

BRIEF DESCRIPTION OF THE DRAWINGS

The present invention and its beneficial technical effects are further described in detail below based on the drawings and specific embodiments, wherein.

DESCRIPTION OF THE EMBODIMENTS

The present invention will be further described below based on the drawings and specific embodiments, but embodiments of the present invention are not limited thereto.

Figure 1:
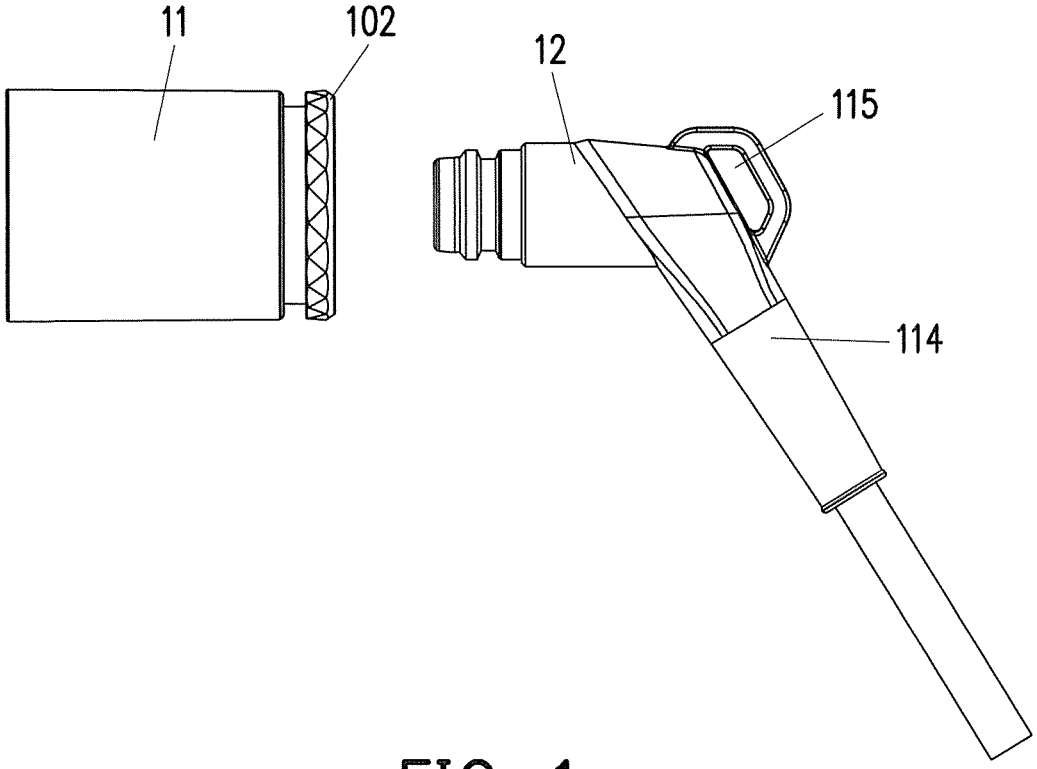
FIG. 1 is a main view of the present invention.
Figure 2:
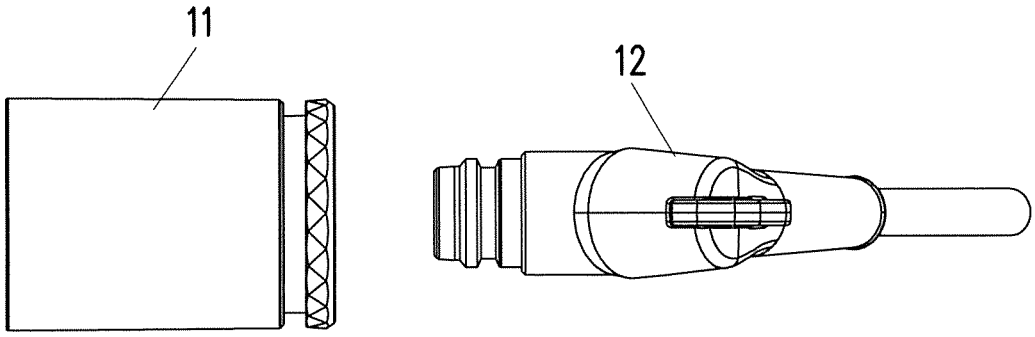
FIG. 2 is a top view of the present invention.
Figure 3:
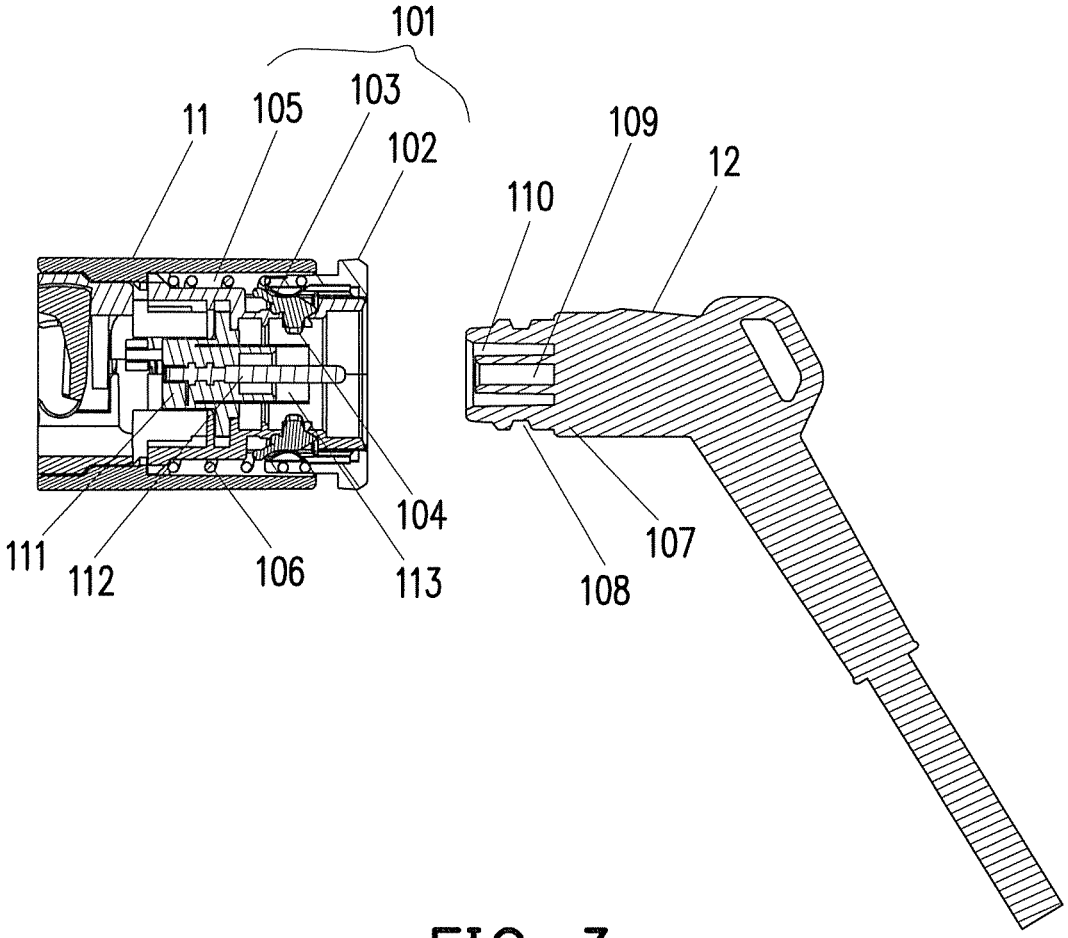
FIG. 3 is a cross-sectional view of the present invention.

As shown in FIG. 1, FIG. 2 and FIG. 3, a detachable power cord structure for a portable hair curler includes a device tail sleeve 11 and a tail wire 12. An elastic engaging assembly 101 is arranged in the device tail sleeve 11. The tail wire 12 is inserted into the device tail sleeve 11 and is engaged with the elastic engaging assembly 101. When the tail wire 12 is engaged into the elastic engaging assembly 101, it can turn on the circuit and can be rotated freely.

Preferably, the elastic engaging assembly 101 includes a tail spring ring 102. One end of the tail spring ring 102 extending into the device tail sleeve 11 is provided with a buckle 103. The inside of the buckle 103 is provided with a protrusion 104, and a spring groove 105 is disposed on the inner side wall of the device tail sleeve 11. A tail spring 106 is disposed in the spring groove 105. The tail spring ring 102 extends into the device tail sleeve 11 and abuts against the tail spring 106.

Preferably, the tail wire 12 has an insertion end 107. The outer side of the insertion end 107 is provided with an annular groove 108. The axial center of the insertion end 107 is provided with a positive insertion port 109, and the insertion end 107 is further provided with an annular negative insertion slot 110 therein. The protrusion 104 of the buckle 103 is docked with the annular groove 108.

Preferably, the device tail sleeve 11 is further provided with a socket terminal 111. The socket terminal 111 is provided with a positive contact pin 112 and an annular negative contact piece 113. The positive contact pin 112 is inserted into the positive insertion port 109 in an aligned manner, and the annular negative contact piece 113 is docked with the annular negative insertion slot 110. The socket terminal 111 is electrically connected to a PCB board 5.

Preferably, when the tail spring ring 102 is pushed to press the tail spring 106, the buckle 103 moves along with the tail spring ring 106 and is detached from the tail wire 12.

Preferably, the annular negative insertion slot 110 is provided with a power negative contact terminal, and the positive insertion port 109 is provided with a power positive contact terminal therein.

Preferably, the power negative contact terminal is disposed around the annular negative insertion slot 110. When the annular negative insertion slot 110 is docked with the contact terminal of the hairdressing appliance, the power negative contact terminal can completely contact the terminal to ensure electrical connection. The annular negative insertion slot 110 has a certain insertion and positioning function.

Preferably, the other end of the tail wire 12 is a power cord buried end 114, and an angle greater than 90 degrees is formed between the power cord buried end 114 and the insertion end 107.

Preferably, a side of the power cord buried end 114 is provided with a hanging hole 115. The hanging hole 115 facilitates the hanging of the power connector and makes it easy for the worker to pick and place.

Preferably, the power cord buried end 114 and the insertion end 115 are integrally formed by injection molding. The power positive contact terminal and the power negative contact terminal are all hidden in the tail wire, and the safety performance is higher.

The power connector structure adopted by the present invention can be rotated through insertion of the device tail sleeve and the tail wire. An elastic engaging assembly is arranged in the device tail sleeve, the tail wire is inserted into the device tail sleeve and is engaged with the elastic engaging assembly. When the tail wire is engaged into the elastic engaging assembly, it can turn on the circuit and can be rotated freely. When the tail wire is electrically connected, it can be rotated freely without bending or curing during use, thereby effectively ensuring the service life of the tail wire.

While the embodiments of the present invention have been shown and described, it will be understood by those skilled in the art that variations, amendments, replacement and modification can be made to the embodiments without departing from the principle and structure of the present invention. The scope of the present invention is defined by the appended claims and its equivalent.

What is claimed is:

1. A detachable power cord structure for a portable hair curler, comprising a device tail sleeve and a tail wire, wherein the device tail sleeve is provided with an elastic engaging assembly, and the tail wire is inserted into the device tail sleeve, and is engaged with the elastic engaging assembly, when the tail wire is engaged in the elastic engaging assembly and can turn on a circuit and can be rotated freely, wherein the elastic engaging assembly comprises a tail spring ring, and one end of the tail spring ring extending into the device tail sleeve is provided with a buckle, a protrusion is arranged on an inner side of the buckle, a spring groove is arranged on an inner side wall of the device tail sleeve, and a tail spring is arranged in the spring groove, and the tail spring ring extends into the device tail sleeve and abuts against the tail spring.

2. The detachable power cord structure for the portable hair curler according to claim 1, wherein the tail wire has an insertion end, and an outer side of the insertion end is provided with an annular groove, an axial center of the insertion end is provided with a positive insertion port, and an annular negative insertion slot is further provided in the insertion end, and a protrusion of the buckle is docked with the annular groove.

3. The detachable power cord structure for the portable hair curler according to claim 2, wherein the device tail sleeve is further provided with a socket terminal, and the socket terminal is provided with a positive contact pin and an annular negative contact piece, the positive contact pin is inserted into the positive insertion port in an aligned manner, and the annular negative contact piece is docked with the annular negative insertion slot.

4. The detachable power cord structure for the portable hair curler according to claim 3, wherein when the tail spring ring is pushed to press the tail spring, the buckle moves along with the tail spring ring and is detached from the tail wire.

5. The detachable power cord structure for the portable hair curler according to claim 3, wherein the annular negative insertion slot is provided with a power negative contact terminal therein, and the positive insertion port is provided with a power positive contact terminal therein.

6. The detachable power cord structure for the portable hair curler according to claim 5, wherein the power negative contact terminal is disposed around the annular negative insertion slot.

7. The detachable power cord structure for the portable hair curler according to claim 3, wherein the other end of the tail wire is a power cord buried end, and an angle greater than 90 degrees is formed between the power cord buried end and insertion end.

8. The detachable power cord structure for the portable hair curler according to claim 7, wherein a side of the power cord buried end is provided with a hanging hole.

9. The detachable power cord structure for the portable hair curler according to claim 7, wherein the power cord buried end and the insertion end are integrally injection molded.

* * * * *